US006852274B2

(12) United States Patent
Knünz et al.

(10) Patent No.: US 6,852,274 B2
(45) Date of Patent: Feb. 8, 2005

(54) METHOD FOR PRODUCING HARD METAL GRANULATE

(75) Inventors: Gerhard Knünz, Lechaschau/Tirol (AT); Helmut Beirer, Pflach/Tirol (AT); Andreas Lackner, Reutte/Tirol (AT); Wolfgang Glätzle, Reutte/Tirol (AT); Erwin Hartlmayr, Breitenwang/Tirol (AT)

(73) Assignee: Ceratizit Austria Gesellschaft m.b.H., Reutte (AT)

( * ) Notice: Subject to any disclaimer, the term of this patent is extended or adjusted under 35 U.S.C. 154(b) by 200 days.

(21) Appl. No.: 10/302,204

(22) Filed: Nov. 22, 2002

(65) Prior Publication Data

US 2003/0061906 A1 Apr. 3, 2003

Related U.S. Application Data

(63) Continuation of application No. PCT/AT02/00077, filed on Mar. 8, 2002.

(30) Foreign Application Priority Data

Mar. 29, 2001 (AT) ..... GM231/2001

(51) Int. Cl.[7] ..... B22F 1/00
(52) U.S. Cl. ..... 419/10; 419/30; 419/32
(58) Field of Search ..... 419/10, 30, 32

(56) References Cited

U.S. PATENT DOCUMENTS

| | | | | |
|---|---|---|---|---|
| 4,070,184 A | | 1/1978 | Scheithauer, Jr. et al. | |
| 4,397,889 A | | 8/1983 | Benjamin et al. | |
| 5,348,914 A | * | 9/1994 | Thometzek et al. | 501/18 |

FOREIGN PATENT DOCUMENTS

| | | |
|---|---|---|
| DE | 299 858 A7 | 5/1992 |
| EP | 0 763 605 A | 3/1997 |
| WO | WO 96/24454 | 8/1996 |

* cited by examiner

*Primary Examiner*—Daniel Jenkins
(74) *Attorney, Agent, or Firm*—Laurence A. Greenberg; Werner H. Stemer; Ralph E. Locher

(57) ABSTRACT

A hard metal granulate is produced by wet milling and spray drying in a spray tower using pure water as the liquid phase. The spray tower is configured and operated in such a way that a ratio of the quantity of water added via the slurry (in liters per hour) to tower volume (in $m^3$) is between 0.5 and 1.8 and in that a maximum of 0.17 kg of slurry is atomized per $m^3$ of incoming drying gas. The slurry has a solid particle concentration within a range of 65–85% by weight. Under these conditions, the addition of a water-soluble, long-chain polyglycol to the slurry prior to spraying previously required in order to prevent oxidation of the hard metal granulate is no longer necessary.

12 Claims, 2 Drawing Sheets

METHOD FOR PRODUCING HARD METAL GRANULATE

CROSS-REFERENCE TO RELATED APPLICATION

This application is a continuation of copending international application No. PCT/AT02/00077, filed Mar. 8, 2002, which designated the United States and which was not published in English.

BACKGROUND OF THE INVENTION

Field of the Invention

The invention relates to a method for producing a hard metal granulate. The process involves wet milling of the hard material and binding metal components that are desired in the finished granulate and the formation of a sprayable slurry using pure water as a liquid phase. The slurry is converted to granular form in a spray tower through spray drying in a gas stream with a gas entry temperature in the range from 160° to 220° C. and a gas exit temperature ranging from 85° to 130° C. The spray tower has a cylindrical segment and a conical segment.

Molded parts made of hard metal alloys are produced by pressing and sintering powdered base materials. In order to make them easier to process, the fine-grained base powder of the hard metal alloys with a mean particle size in the range of only several microns ($\mu$m) and often smaller are converted to granular form, i.e. in the most ideal spherical form possible with a mean particle size of at least 90 $\mu$m. This is accomplished by milling the hard material and binding metal components in a liquid medium to form a finely dispersed mixture which takes the form of a slurry. When coarser-grained starting powders are used, this step also involves milling the starting powders, whereas the slurry is merely homogenized when fine-grained starting powders are used. The liquid protects the powder particles against fusion and prevents them from oxidizing during the milling process.

Suitable milling systems used almost exclusively in present day processing are agitator ball mills known as attritors. There, the material to be milled is set in motion together with hard metal balls by a multiple-blade agitator arm inside a cylindrical container. A pressing aid, e.g. paraffin, can be introduced to the slurry produced through the liquid-enhanced milling process, if appropriate. The addition of a pressing aid is necessary especially in cases where the finished granulate is pressed in compacting dies into the desired form.

The pressing aid gives the granulate better compression properties during the pressing process and also enhances its flow characteristics, which facilitates the filling of compacting dies. If the finished hard metal granulate is to be further processed in an extruder press, no pressing aid is normally added to the slurry. The slurry is brought to a sprayable consistency, then dried and granulated simultaneously in a spray drying system. In this process, the slurry is sprayed through a nozzle positioned inside the spray tower. A stream of hot gas dries the airborne spray droplets, which then precipitate as granulate in the form of small granules or beads in the lower conical segment of the spray tower, from where it can then be removed. In the hard metal industry, such organic solvents as acetone, alcohol, hexane or heptane are still used almost exclusively in the milling and pressing of slurries today. These solvents are used in concentrated form or diluted only slightly with water.

Because all of these solvents are highly flammable and volatile, attritors and spray drying systems must be designed as explosion-resistant units, which requires considerable engineering design input and thus generates high costs. In addition, the materials must be dried in an inert gas atmosphere, ordinarily nitrogen, in the spray tower.

All of the above-mentioned solvents are also environmental pollutants and are subject to substantial evaporation loss, despite the use of recycling measures, due to their high volatility.

Spray towers in spray drying systems used in the hard metal industry are designed with a cylindrical upper segment and a conical, downward pointing lower segment and ordinarily operate in a countercurrent mode in accordance with the fountain principle, i.e. the sprayer lance is positioned in the center of the lower segment of the spray tower and sprays the slurry under high pressure (12–24 bar) upward in the form of a fountain. The gas stream which dries the sprayed droplets flows into the drying chamber from above, counter to the travel direction of the sprayed droplets, and escapes from the spray tower in the upper third portion of the conical, downward pointing segment below the spray lance. In this way, the droplets are first conveyed upward and then pulled downward by the force of gravity and the opposing stream of gas. In the course of the drying cycle, the droplets are transformed into a compact granulate with a low residual moisture content. As they fall to the floor of the spray tower, they automatically trickle down through the conical, downward pointing lower segment to the central discharge outlet.

Because the flight pattern of the sprayed droplets takes them first upward and then down, the distance traveled by the droplets during drying is equivalent to that of spray towers that operate with co-current downward streams of sprayed slurry and drying gas, but the process requires almost fifty percent less tower height. This results in a more compact spray tower construction.

Spray towers in practical use which operate with countercurrents on the basis of the fountain principle have a cylindrical segment measuring between 2 and 9 m in height with a height to diameter ratio of between 0.9 and 1.7, whereas spray towers which operate in a co-current mode with top-down gas and sludge flow are equipped with a cylindrical segment measuring between 5 and 25 m in height with height to diameter ratio ranging from 1 to 5.

In this specification, the general term "hard metal" is intended to also encompass so-called cermets, a special group of hard metals, which ordinarily contain hard materials with nitrogen.

U.S. Pat. No. 4,070,184 describes a process for producing a hard metal granulate involving milling and spray drying wherein pure water is used instead of organic solvents for milling and production of the sprayable slurry. The use of water as a liquid phase eliminates the need to construct attritors and spray drying systems as explosion-resistant units, which helps to reduce costs. In spray drying, air may be used instead of inert gas as a drying medium. Moreover, eliminating the use of organic solvents entirely rules out health risks posed by solvent vapors.

The major disadvantage of this process is that the use of pure water and air results in increased impairment of powder quality through oxidation. Extremely fine-grained hard metal powders with a mean particle size of 0.5–0.6 $\mu$m, which correlates on the basis of BET measurement to a surface area of 1.6–3.2 $m^2/g$, which is used for many types of hard metal grades today, are highly susceptible to oxidation due to their large surface area and thus cannot be produced using this process. Even for hard metal powders with a larger mean particle size of 1 $\mu$m and slightly less and thus a considerably smaller surface area—the smallest standard particle sizes in common use at the time the US patent was registered, it was necessary to reduce susceptibility to oxidation by adding a long-chain polyglycol to the slurry immediately prior to spray drying. Such polyglycols, which also make the granulates more compactable, completely enclose the powder particles and thus largely prevent oxidation of the particles during spray drying.

The disadvantage of this process is that polyglycols of this type exhibit unfavorable vaporizing behavior during sintering of the pressed powder. Complete vaporization occurs only at temperatures between 250° and 300° C., which, due to vaporization over a broad temperature range, can cause the part to crack or form fissures.

SUMMARY OF THE INVENTION

It is accordingly an object of the invention to provide a method for producing a hard metal granulate through milling and spray drying using water as a liquid phase, which overcomes the above-mentioned disadvantages of the heretofore-known devices and methods of this general type and wherein extremely fine-grained hard metal powder is milled and sprayed and wherein the disadvantages of prior art affecting the sintering process are avoided.

With the foregoing and other objects in view there is provided, in accordance with the invention, a method of producing a hard metal granulate, which comprises:

wet milling hard material and binding metal components desired in the hard metal granulate and preparing a sprayable slurry with water as a liquid phase and having a solid particle concentration within a range of 65–85% by weight;

introducing the slurry into a spray tower spray-drying the slurry in a gas stream having a gas inlet temperature of substantially 160° to 220° C. and a gas exit temperature in a range of substantially 85° to 130° C., to convert the slurry to granular form;

wherein the slurry is sprayed and dried substantially without addition of a water-soluble long-chain polyglycol in the spray tower; and wherein the spray tower is constructed and operated such that a ratio of water added with the slurry, in liters per hour, to a tower volume of the spray tower, in $m^3$, lies between 0.5 and 1.8 and such that a maximum of 0.17 kg of slurry is atomized per $m^3$ of incoming drying gas.

In a preferred embodiment, the slurry is dried in a spray tower that is formed with a cylindrical segment and an adjoining conical segment.

With the above and other objects in view there is also provided, in accordance with the invention, a spray drying system for performing the above-outlined method, i.e., for producing a hard metal granulate. The system comprises:

means for wet-milling hard material and binding metal components desired in the hard metal granulate and for preparing a sprayable slurry with water as a liquid phase and having a solid particle concentration within a range of 65–85% by weight;

a spray tower having a given tower volume, said spray tower including a cylindrical segment and an adjoining conical segment, and means for introducing the slurry into the spray tower;

means for generating a gas stream in said spray tower for spray-drying the slurry, the gas stream having a gas inlet temperature of substantially 160° to 220° C. and a gas exit temperature in a range of substantially 85° to 130° C.;

wherein said spray tower and said means are configured to spray and dry the slurry substantially without addition of a water-soluble long-chain polyglycol in said spray tower and to convert the slurry to granular form; and wherein said spray tower is constructed such that a ratio of water added with the slurry, in liters per hour, to said tower volume of the spray tower, in $m^3$, lies between 0.5 and 1.8 and such that a maximum of 0.17 kg of slurry is atomized per $m^3$ of incoming drying gas.

In conformity with the process described in the introduction, the objects of the invention are achieved by the invention in that the slurry is sprayed and dried without the addition of a water-soluble, long-chain polyglycol and in that the spray tower is designed and operated in such a way that the ratio of the quantity of water added via the slurry (in liters per hour) to tower volume (in $m^3$) is between 0.5 and 1.7 and in that a maximum of 0.17 kg of slurry is atomized per $m^3$ of incoming drying gas, whereby the slurry has a solid particle concentration within a range of 65–85% by weight.

It is accepted as given that available energy generated by the volume and temperature of the incoming gas stream must be sufficient to vaporize the added quantity of water without difficulty.

The essential characteristic of the process embodying the invention is that the quantity of water added via the slurry must be must smaller in proportion to tower volume than is ordinarily the case in spray towers and that the air quantity must be adjusted to the sprayed slurry so as to ensure that at least 1 $m^3$ of air is available per 0.17 kg of slurry. In this way, the process achieves under currently prevailing conditions both non-destructive drying and a maximum residual moisture concentration of 0.3% by weight in proportion to the finished granules.

A solid particle concentration in the slurry within the range of 70 to 80% by weight has proven particularly advantageous. Oxidation of even extremely fine-grained starting powders is largely avoided under the process conditions described above, meaning that dispensing with the use of polygycols in granulate production results in no disadvantages whatsoever.

It goes without saying that in this process, as is generally the case in the production of hard metal granulates, the carbon balance must be adjusted on the basis of the chemical analysis of the starting powder used and oxygen intake during milling and spray drying, if necessary by adding carbon prior to milling, so as to ensure that a finished sintered hard metal can be produced with the hard metal granulate without an eta phase and without free carbon.

As a rule, the mean particle size of the granulate produced lies between 90 and 250 $\mu$m and can be adjusted by changing the size of the spray nozzle opening, the viscosity of the sprayed slurry and/or the spraying pressure. Smaller nozzle openings, lower viscosities and higher spraying pressures lower the mean particle size. The quantity of slurry introduced through the spray nozzle is regulated by adjusting the spraying pressure or the size of the swirl chamber and/or the spray nozzle opening.

Although the process embodying the invention can be used in both co-current and countercurrent spray drying systems, it has proven most effective in countercurrent spray drying systems that operate according to the fountain principle, which favors a more compact construction of the spray drying system.

It has also proven advantageous to construct the upper cylindrical segment of the spray tower with a height of approximately 6 m and a diameter of between 4 and 5 m. A conical angle of about 45°–50° in the lower conical segment has also proven favorable.

A particular advantage of the process embodying the invention is that it permits the use of air as a drying gas, which makes the process extremely cost-effective.

The use of a single-component nozzle has proven effective in keeping oxidation of the particles during spray drying to a minimum. In single-component nozzles—as opposed to two-component nozzles, wherein the slurry to be atomized is introduced into the nozzle together with a stream of gas—only the slurry is introduced under pressure, which further reduces contact with a potentially oxidizing stream of gas.

Particularly advantageous in the production of hard metal granulate in accordance with the invention is the milling of the powder in an attritor with a slurry viscosity ranging between 2,500 and 8,000 mPa·s (measured in an RC 20 rheometer manufactured by Europhysics at a shear rate of 5.2 [1/s]) and four-to-eight-fold volume exchange per hour.

In this way, it is possible to achieve such short milling times even in the production of slurry containing hard material and binding metal components with particle sizes significantly below 1 μm that excessive particle oxidation is avoided.

Where longer milling times are necessary in extreme cases for the production of smaller particles within the specific viscosity range, it is advantageous to add an antioxidant, such as an amine-based compound, e.g. aminoxethylate or Resorcin, to the water prior to milling and/or spray drying. This makes it possible to prevent excessive particle oxidation during extended milling times and subsequent spraying.

If the process embodying the invention is performed using a countercurrent spray drying system based on the fountain principle, it is advantageous to adjust the temperature of the inflowing drying air at the upper end of the cylindrical segment and the temperature of the drying air at the point at which it leaves the conical lower segment of the spray tower within the specified ranges in such a way as to set a temperature between 70° and 120° C. at the geometric midpoint (S) of the spray tower. Under these conditions, oxidation of the hard metal granulate is reduced to a minimum.

It is also advantageous to carry out the process embodying the invention in such a way that the granulate in the outlet area of the spray tower is cooled to a maximum temperature of 75° C. and further cooled immediately upon removal from the cooling tower to room temperature. This rapid cooling of the finished hard metal granulate to room temperature also reduces further oxidation considerably. The most effective means of cooling the granulate in the outlet area is to design the conical, downward pointing segment of the spray tower as a double-walled construction cooled with a suitable coolant. Rapid cooling to room temperature can be accomplished, for example, by passing the granulate through a cooling channel after removal from the spray tower.

Other features which are considered as characteristic for the invention are set forth in the appended claims.

Although the invention is illustrated and described herein as embodied in a method for producing hard metal granulate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
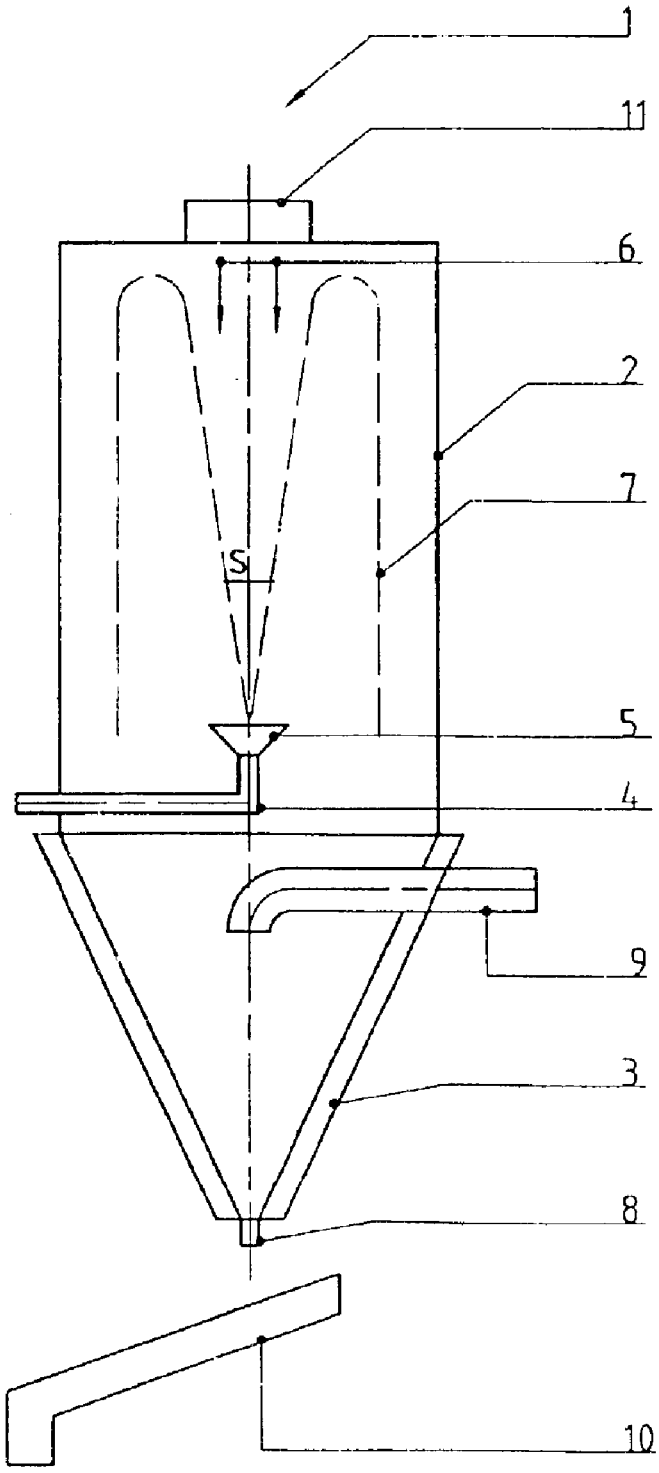
FIG. 1 is a schematic diagram illustrating the basic principle of the spray tower used in the process according to the invention.

Referring now to the figures of the drawing in detail and first, particularly, to FIG. 1 thereof, there is shown spray tower 1 formed with a cylindrical segment 2 and an attached lower, downwardly pointing, conical segment 3. The spray tower 1 operates in a countercurrent mode in accordance with the fountain principle, i.e. the stream of gas which dries the granulate is introduced at an upper end 11 of the cylindrical segment and forced downward, while the atomized slurry is sprayed upward similarly to a fountain against the direction of gas flow 6. The slurry is introduced through a spray lance 4 with a nozzle opening 5 from the lower end of the cylindrical segment.

Thus the sprayed liquid droplets 7 initially travel upward before reversing their course in response to the opposing gas current and the force of gravity and falling downward. Before coming to rest on the floor of the spray tower 1 in the conical, downward pointing segment 3, the liquid droplets 7 must be transformed into dry granulate.

The granulate is guided through the conical, downward pointing segment 3 of the spray tower to the discharge outlet 8. The gas stream 6 enters the cylindrical segment 2 at a temperature between 160° and 220° C. and escapes from the spray tower through the gas outlet pipe 9 below the spray lance 4 in the upper third portion of the conical segment 3 at a temperature between 85° and 130° C. Preferably, the gas entry and exit temperatures are adjusted in such a way as to achieve a temperature between 70° and 120° C. at a geometric midpoint S of the spray tower. It is essential that the ratio of the quantity of water added via the slurry in liters per hour to tower volume in $m^3$ is between 0.5 and 1.8 and in that a maximum of 0.17 kg of slurry is atomized per $m^3$ of incoming drying gas, whereby the slurry should have a solid particle concentration within the range of 65–85% by weight. It must also be ensured, of course, that available energy generated by the quantity and temperature of the incoming gas stream must be sufficient to vaporize the added quantity of water without difficulty.

It is advantageous to design the conical segment 3 of the spray tower as a double-wall construction to accommodate circulation of a coolant, e.g. water. This will ensure that the granulate is cooled in this segment of the spray tower to a temperature not exceeding 75° C.

After leaving the spray tower 1 through the discharge outlet 8, the granulate enters a cooling channel 10, where it is cooled to room temperature.

The invention will now be described in the following text with reference to a production example.

EXAMPLE

In order to produce a hard metal granulate with a mean particle size of 135 μm consisting of 6% cobalt by weight, 0.4% vanadium carbide by weight, and a remainder of tungsten carbide, 36 kg of powdered cobalt with a mean particle size of 0.63 μm FSSS and an oxygen content of 0.56% by weight, 2.4 kg of powdered vanadium carbide with a mean particle size of about 1.2 μm FSSS and an oxygen content of 0.25% by weight and 563.5 kg of tungsten carbide powder with a BET surface area of 1.78 $m^2/g$, which corresponds to a mean particle size of about 0.6 μm, and an oxygen content of 0.28% by weight were milled with 150 liters of water in an attritor for 5 hours. The materials were milled with 2000 kg of hard metal balls measuring 9 mm in diameter at an attritor speed of 78 rpm. Pump circulation capacity was 1000 liters of slurry per hour. The temperature of the slurry was kept constant at about 40° C. during milling. Water was added to the finished milled slurry to achieve a solid particle concentration of 75% by weight and a viscosity of 3000 mPa·s.

For granulation of the slurry produced in this way, a spray tower 1 with a cylindrical segment 2 measuring 6 m in height and 4 m in diameter and a conical, downward pointing segment 3 with a conical angle of 50° was used. Tower volume was 93 $m^3$. The spray tower was designed for countercurrent operation on the basis of the fountain principle. Air was used to dry the slurry and was introduced into the spray tower at a rate of 4000 $m^3/h$.

The slurry was sprayed into the spray tower through a spray lance 4 with a single-component nozzle 5 with an outlet opening measuring 1.12 mm in diameter at a pressure of 15 bar, which resulted in a slurry concentration of 0.08 kg slurry per $m^3$ of drying air. The air exit temperature was set at a constant value of 85° C., which was achieved under the prevailing conditions by introducing drying air at a temperature of 145° C. At an air inflow rate of 4,000 $m^3$ per hour, the atomization of 0.08 kg of slurry per $m^3$ of drying air resulted in a spray rate of 320 kg of slurry per hour. Since the solid particle concentration of the slurry was set at 75% by weight, the spray output of 320 kg per hour equates to an hourly input of 80 liters of water.

Thus ratio of water input per hour to tower volume was $$\frac{80\ \text{l/h}}{93\ \text{m}^3} = \frac{0.86\ \text{l}}{\text{m}^3 \cdot \text{h}}$$

The oxygen concentration in the granulate produced was 0.53% by weight.

Figure 2:
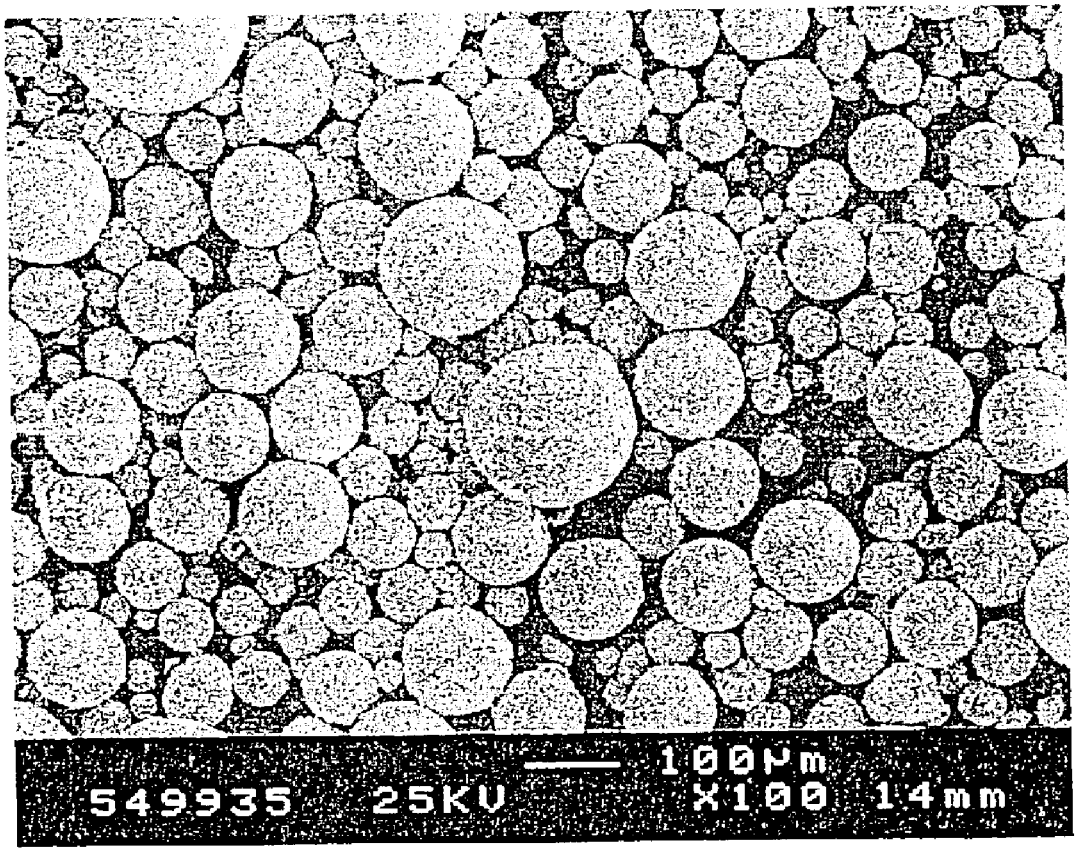
FIG. 2 is a SEM micrograph (100×enlargement) of a hard metal granulate produced with a mean particle size of 135 μm in accordance with the above example.

FIG. 2 shows a SEM image (scanning electron microscope, at 100× enlargement) of the hard metal granulate produced with a mean particle size of 135 μm. The granulate was produced in accordance with the above example.

We claim:

1. A method of producing a hard metal granulate, which comprises:

wet milling hard material and binding metal components desired in the hard metal granulate and preparing a sprayable slurry with water as a liquid phase and having a solid particle concentration within a range of 65–85% by weight;

introducing the slurry into a spray tower spray-drying the slurry in a gas stream having a gas inlet temperature of substantially 160° to 220° C. and a gas exit temperature in a range of substantially 85° to 130° C., to convert the slurry to granular form;

wherein the slurry is sprayed and dried substantially without addition of a water-soluble long-chain polyglycol in the spray tower; and wherein the spray tower is constructed and operated such that a ratio of water added with the slurry, in liters per hour, to a tower volume of the spray tower, in $m^3$, lies between 0.5 and 1.8 and such that a maximum of 0.17 kg of slurry is atomized per $m^3$ of incoming drying gas.

2. The method according to claim 1, which comprises introducing and drying the slurry in a spray tower consisting of a cylindrical segment and an adjoining conical segment.

3. The method for producing a hard metal granulate according to claim 1, which comprises preparing the slurry with a solid particle concentration in a range from 70 to 80% by weight.

4. The method for producing a hard metal granulate according to claim 1, wherein the spray-drying step comprises spray-drying in a countercurrent process based on a fountain principle.

5. The method for producing a hard metal granulate according to claim 4, which comprises setting the gas inlet temperature and the gas exit temperature such that a temperature of between 70° and 120° is achieved at a geometric midpoint of the spray tower.

6. The method for producing a hard metal granulate according to claim 1, which comprises introducing air as a drying gas.

7. The method for producing a hard metal granulate according to claim 1, which comprises spraying the slurry with a single-component nozzle.

8. The method for producing a hard metal granulate according to claim 1, wherein the wet milling step comprises milling in an attritor, with the slurry having a viscosity ranging from 2,500 to 8,000 mPa·s, and with a four-fold to-eight-fold volume exchange per hour.

9. The method for producing a hard metal granulate according to claim 1, which comprises adding an amino-compound-based antioxidant to the water prior to one of wet milling and spray drying.

10. The method for producing a hard metal granulate according to claim 1, which comprises cooling the granulate in an outlet area of the spray tower to a temperature not exceeding 75° C. and rapidly cooling the granulate to substantially room temperature following removal from the cooling tower.

11. A spray drying system for producing a hard metal granulate, the system comprising:

means for wet-milling hard material and binding metal components desired in the hard metal granulate and for preparing a sprayable slurry with water as a liquid phase and having a solid particle concentration within a range of 65–85% by weight;

a spray tower having a given tower volume, said spray tower including a cylindrical segment and an adjoining conical segment, and means for introducing the slurry into the spray tower;

means for generating a gas stream in said spray tower for spray-drying the slurry, the gas stream having a gas inlet temperature of substantially 160° to 220° C. and a gas exit temperature in a range of substantially 85° to 130° C.;

wherein said spray tower and said means are configured to spray and dry the slurry substantially without addition of a water-soluble long-chain polyglycol in said spray tower and to convert the slurry to granular form; and wherein said spray tower is constructed such that a ratio of water added with the slurry, in liters per hour, to said tower volume of the spray tower, in $m^3$, lies between 0.5 and 1.8 and such that a maximum of 0.17 kg of slurry is atomized per $m^3$ of incoming drying gas.

12. A method of producing a hard metal alloy, which comprises: forming a hard metal granulate with the method according to claim 1, and sintering the hard metal granulate together with further components to form a sintered hard metal alloy.

* * * * *